US005819561A

United States Patent [19]

Blehi, III

[11] Patent Number: 5,819,561

[45] Date of Patent: Oct. 13, 1998

[54] SECURITY DOOR-LOCKING SYSTEM

[76] Inventor: Andrew Blehi, III, 65860 Highway 60 P.O. Box 522, Salome, Ariz. 85348

[21] Appl. No.: 775,720

[22] Filed: Dec. 20, 1996

[51] Int. Cl.[6] ..... E05C 19/18

[52] U.S. Cl. ..... 70/14; 70/34; 70/102; 292/289; 292/295; 292/296

[58] Field of Search ..... 70/14, 2, 6, 34, 70/101, 102; 292/258, 288–298

[56] References Cited

U.S. PATENT DOCUMENTS

| | | | |
|---|---|---|---|
| 321,775 | 7/1885 | Woodward | 292/295 |
| 787,847 | 4/1905 | Kollme | 292/297 |
| 928,820 | 7/1909 | Tabor | 70/14 |
| 1,074,230 | 9/1913 | Wiseman | 292/297 |
| 1,579,298 | 4/1926 | Fry et al. | 292/298 |
| 2,104,066 | 12/1938 | White | 292/296 |
| 2,461,398 | 2/1949 | Sands | 292/297 |
| 3,423,968 | 1/1969 | Foote | 70/14 |
| 3,429,151 | 2/1969 | Weingart | 70/14 |
| 3,640,558 | 2/1972 | Gewertz et al. | 292/288 X |
| 4,506,527 | 3/1985 | Grill | 70/14 |
| 4,593,946 | 6/1986 | Rich | 292/288 |
| 4,869,086 | 9/1989 | Richards | 70/416 |
| 4,885,919 | 12/1989 | Loughlin et al. | 70/34 |
| 5,325,685 | 7/1994 | Frank | 70/14 |
| 5,515,704 | 5/1996 | van Nguyen | 292/288 X |

FOREIGN PATENT DOCUMENTS

| | | | |
|---|---|---|---|
| 751628 | 1/1967 | Canada | 292/296 |
| 58842 | 4/1954 | France | 70/14 |
| 1185078 | 3/1970 | United Kingdom | 70/14 |

*Primary Examiner*—Lloyd A. Gall
*Attorney, Agent, or Firm*—Martin L. Stoneman

[57] ABSTRACT

A security door-locking system is described for locking closed doors of tractor cabs on truck tractors, for example, of the type used to pull over-the-road common truck trailers, and vehicles, etc., with similar pre-existing door latching systems. A flat rigid bar has a hole near one end for fitting over the striker pin on the door jamb; and the other end of the bar may be attached to a lock outside the tractor cab after the door is closed. A retainer between the lock and the door/door-jamb provides a secure locking arrangement. And a system like a ratchet provides for attaching the lock to the bar in a tight position with the door.

20 Claims, 2 Drawing Sheets

FIG. 1
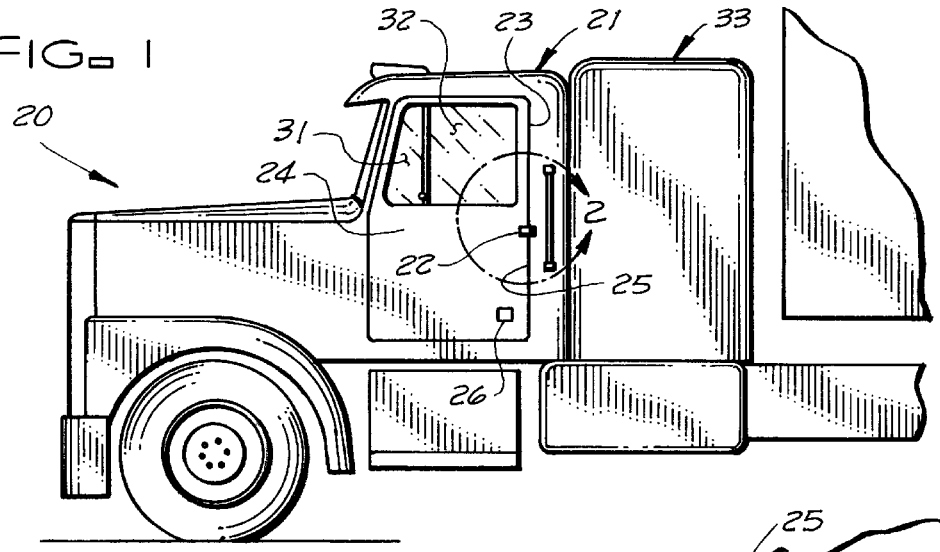
FIG. 2
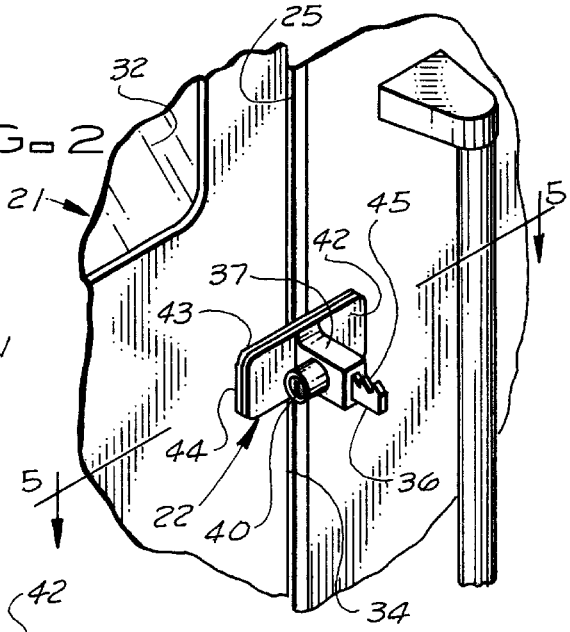
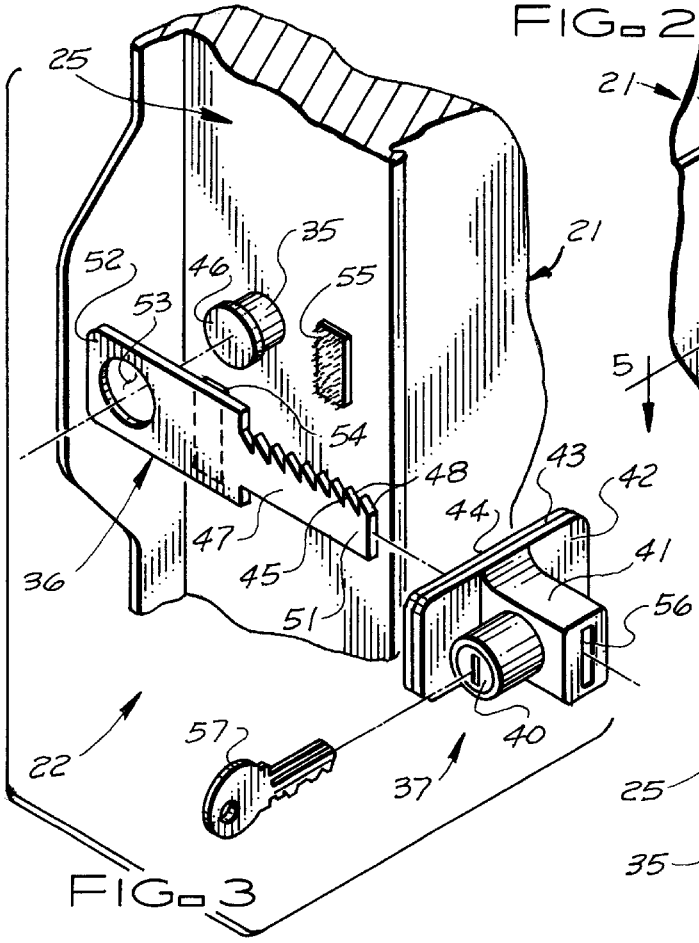
FIG. 3
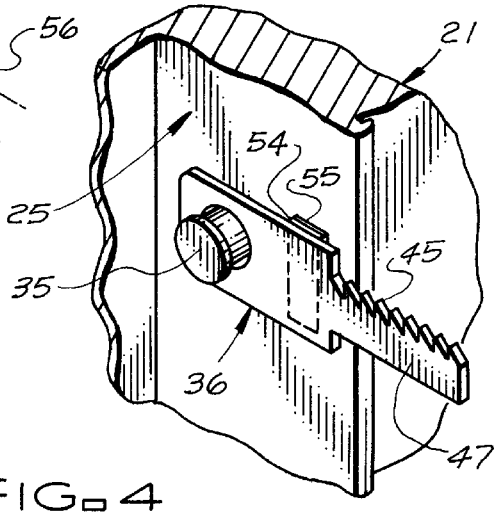
FIG. 4

FIG. 5
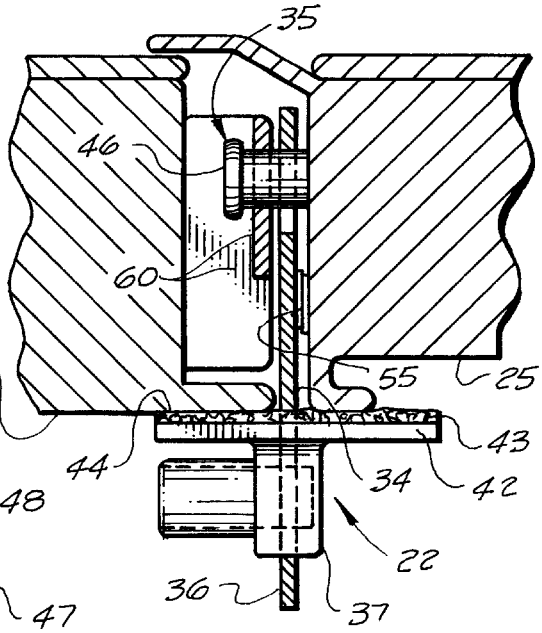
FIG. 6
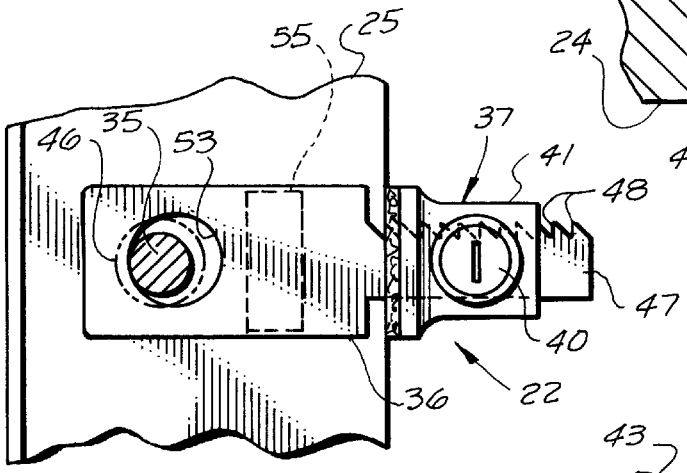
FIG. 7
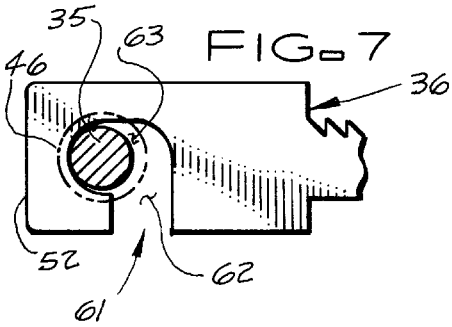
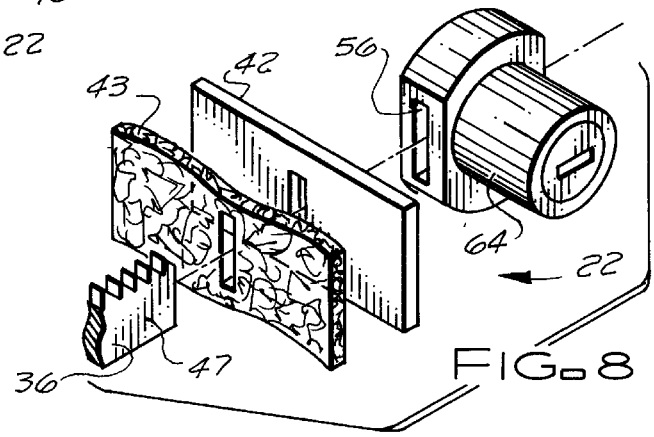
FIG. 8
FIG. 10
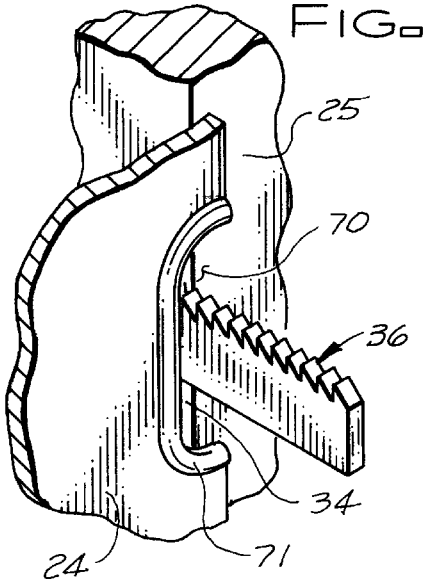
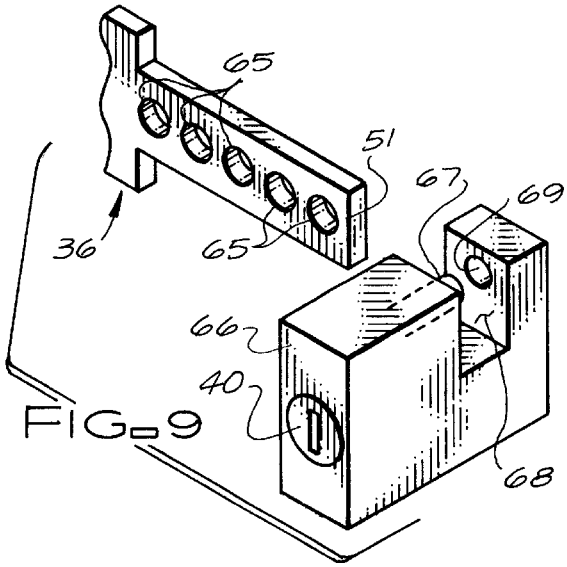
FIG. 9

SECURITY DOOR-LOCKING SYSTEM

BACKGROUND OF THE INVENTION

1. Field of the Invention

This invention relates to a security door-locking system, as for vehicle doors. More particularly, this invention concerns a security door-locking system for locking closed doors of tractor cabs on truck tractors, for example, of the type used to pull over-the-road common truck trailers, and vehicles with similar pre-existing door latching systems.

2. Description of the Prior Art

Typically, especially in over-the-road trucking, unwanted and unlawful entry into the cab's interior may be gained either by breaking a door lock or breaking in through a window and then opening a door. Wind wing windows, if incorporated, are especially vulnerable to jimmying open so that one can reach in and unlatch the door. Additionally, an intruder, with a relatively small assortment of keys which a particular manufacturer uses, may be able to unlock the door to gain entry to many truck cabs. Over-the road tractors with sleeping compartments (frequently with husband-wife teams) usually contain many valuables, e.g., tv, microwave, refrigerator, clothing, etc. These and other valuables make an appealing target for the would-be thief. Thus, although needed, the prior art has not provided a simple and easy-to-use security door-locking system.

OBJECTS OF THE INVENTION

A primary object of the present invention is to fulfill the above-mentioned need by the provision of a security door-locking system. A further primary object of the present invention is to provide such a system which is efficient, inexpensive, and handy. In addition, it is a primary object of this invention to provide such a system in connection with truck tractor cabs, to prevent the unwanted unlocking and opening of cab doors as previously mentioned. A further primary object of the present invention is to prevent the cab door from being unlocked from either the inside or outside until the security locking system is unlocked. Other objects of this invention will become apparent with reference to the following invention descriptions.

SUMMARY OF THE INVENTION

According to a preferred embodiment of the present invention, this invention provides a security door-locking system for locking an opening incorporating a hinged door, with a hinged side and an opening-outward side, and, adjacent such opening-outward side of such door, a door-jamb portion incorporating a striker pin adapted to be latched by a latch on such door, such system comprising: a lock; and bar means for rigid extension between such striker pin and such lock, such bar means having first and second ends and comprising holding means adjacent such first end of such bar means for securely holding such first end of such bar means in place abutting such striker pin, and lock attachment means adjacent such second end of such bar means for aiding attachment of such lock on such bar means; such lock, when a such door is closed, being selectively attachable outward of a such opening to such bar means adjacent such second end of such bar means; and such lock being selectively lockable outward of a such opening to such bar means; wherein such system is constructed and arranged in such manner that such door may be held securely shut when such lock is attached on such bar means and such lock is in a locked condition.

Further, this invention provides such a security door-locking system further comprising a rigid retainer constructed and arranged for force transmission between such lock and such door when such lock is attached on such bar means and such lock is in a locked condition. And it provides such a security door-locking system further comprising a protective pad means for protecting such door from being scratched by such rigid retainer when placed between such rigid retainer and such door; and, further, wherein such rigid retainer is constructed and arranged in such manner that, when such lock is attached on such bar means and such lock is in a locked condition, such rigid retainer abuts both a portion of such opening-outward side of such door, exterior to such opening, and an adjoining portion of such door jamb portion, exterior to such opening. It also provides such a security door-locking system further comprising a protective pad means for protecting such door and such adjoining portion of such door jamb portion from being scratched by such rigid retainer when placed between such rigid retainer and such door and between such retainer and such adjoining portion of such door jamb portion.

Additionally, this invention provides such a security door-locking system wherein such lock and such rigid retainer are formed as a unitary member; and, further, wherein such bar means comprises a unitary substantially-flat bar member; and, further, wherein such lock comprises slot means for receiving such second end of such bar member. And it provides such a security door-locking system further comprising first hook-and-loop attachment means on such bar member for aligning such bar member approximately horizontally, in such manner that such second end of such bar member is exterior to such tractor cab, such first hook-and-loop attachment means being constructed and arranged for attachment to a second hook-and-loop attachment means on such door-jamb portion. It also provides such a security door-locking system wherein such holding means comprises a hole through such bar member constructed and arranged in such manner that a such striker pin may pass into such hole; and, further, wherein such holding means comprises a slot in such bar member constructed and arranged in such manner that a such striker pin, at a smallest-diameter portion of such striker pin, may pass into such slot, and a receiving means in such bar member for holding such smallest-diameter portion of a such striker pin after such striker pin passes into such slot; and, further, wherein such lock attachment means comprises a horizontal series of holes in such bar member, each such hole being constructed and arranged to receive a lock pin at a user-selected location; and, further, wherein such lock attachment means comprises tooth means for assisting attachment in ratchet fashion of such bar member to such lock at a user-selected location.

Even further, according to a preferred embodiment hereof, this invention provides a security door-locking system for locking a tractor cab having a tractor-cab door and a tractor-cab door-jamb portion incorporating a striker pin adapted to be latched by a latch on such door, such system comprising: a lock; and bar means for rigid extension between such striker pin and such lock, such bar means having first and second ends and comprising holding means adjacent such first end of such bar means for securely holding such first end of such bar means in place abutting such striker pin, and lock attachment means adjacent such second end of such bar means for aiding attachment of such lock on such bar means; such lock, when such tractor-cab door is closed, being selectively attachable exterior to such tractor-cab door to such bar means adjacent such second end of such bar means; and such lock being selectively lockable exterior to such tractor-cab door to such bar means; wherein such system is constructed and arranged in such manner that such tractor-cab door may be held securely shut when such lock is attached on such bar means and such lock is in a locked condition.

Yet further, this invention provides such a security door-locking system further comprising: a such tractor-cab door; a such tractor-cab door-jamb portion incorporating a striker pin adapted to be latched by a latch on such door; and a rigid retainer, between such lock and such tractor-cab door, constructed and arranged for force transmission between such lock and such tractor-cab door when such lock is attached on such bar means and such lock is in a locked condition; and, further, wherein such rigid retainer is constructed and arranged in such manner that, when such lock is attached on such bar means and such lock is in a locked condition, such rigid retainer abuts both a portion of such door and an adjoining exterior portion of such door jamb portion. And it provides such a security door-locking system further comprising a protective pad means for protecting such door and such adjoining portion of such door jamb portion from being scratched by such rigid retainer when placed between such rigid retainer and such door and between such rigid retainer and such adjoining portion of such door jamb portion. It also provides such a security door-locking further comprising alignment means for aligning such bar means approximately horizontally, in such manner that such second end of such bar means is exterior to such tractor cab; and, further, wherein such tractor door comprises hole means for permitting such second end of such bar means to pass through such hole means when such tractor door is being closed.

Yet additionally, according to a preferred embodiment hereof, this invention provides a security door-locking system for locking a tractor cab having a tractor-cab door and a tractor-cab door-jamb portion incorporating a striker pin adapted to be latched by a latch on such door, such system comprising the steps of: with such tractor cab door open, capturing such striker pin with a first end of a rigid bar in such manner as to prevent outward movement of such first end of such rigid bar; aligning such bar approximately horizontally in such manner that a second end of such bar is exterior to such tractor cab; closing such tractor-cab door in such manner that such second end of such bar remains extended from such tractor cab; providing a lock constructed and arranged to lock onto such bar adjacent such second end at a selected location; moving such lock adjacent such second end of such bar into a lockable location in such manner as to provide a restriction to an opening of such tractor-cab door; and locking such lock onto such bar.

BRIEF DESCRIPTION OF THE DRAWINGS

FIG. 1 is a side elevation view of an over-the-road type semi truck tractor with the tractor cab incorporating the preferred embodiment of the security door-locking system of the present invention.

FIG. 2 is an enlarged perspective view of a portion of the tractor cab with the door-locking system installed.

FIG. 3 is an exploded perspective view of the components of the door-locking system and of a portion of the cab's door jamb.

FIG. 4 is a perspective view of the bar member of the door-locking system installed on the cab door jamb.

FIG. 5 is a cross-sectional plan view of the door-locking system installed on the cab.

FIG. 6 is an elevation view of the door-locking system installed on the cab.

FIG. 7 is an elevation view of a holding-end portion of a bar member illustrating an alternate preferred embodiment.

FIG. 8 is a perspective view of a second preferred embodiment of the lock attachment end of the door-locking system.

FIG. 9 is a perspective view illustrating an alternate preferred embodiment of the lock attachment end of the bar member and of the lock member.

FIG. 10 is a perspective view illustrating a preferred modification, where needed or desired, to the cab door.

DETAILED DESCRIPTION OF A PREFERRED EMBODIMENT AND THE BEST MODE OF PRACTICE

Shown in an elevation view in FIG. 1 is a semi truck tractor 20 with tractor cab 21. The tractor cab 21 is shown utilizing a door-locking system 22 installed, as shown, at the opening-outward side 23 of door 24 and the adjoining door jamb portion 25. The door-locking system 22 is shown on the near (left) side of the tractor cab 21, and an identical door-locking system 22 would additionally be installed on the far (right) side, thus securing the two doors 24 of the tractor cab 21. Completely independent of standard equipment door latches, locks, and handles 26, the door-locking system 22 prevents either door 24 from opening. Although a thief may jimmy open a wind-wing window 31, or enter into the cab through an opened door window 32, opening of the door 24 is prevented. The awkwardness and attention-drawing act of climbing through a window generally would deter a thief from entering the tractor cab 21. As the sleeper compartment 33 may only be entered into through the tractor cab 21, it and its contents are likewise protected by the door-locking system 22. The area of the tractor cab 21 where the door-locking system 22 is installed is encircled with a dotted line in FIG. 1 and is shown in an enlarged perspective view in FIG. 2.

FIG. 2 illustrates the door-locking system 22 installed at the joint gap 34 between the opening-outward side 23 of door 24 and the door jamb portion 25 of tractor cab 21. The door-locking system 22 is installed at the location of the striker pin 35 as shown in FIG. 3 and other drawings. Thus, the system of the present invention is a security door-locking system for locking an opening incorporating a hinged door, with a hinged side and an opening-outward side, and, adjacent such opening-outward side of such door, a door-jamb portion incorporating a striker pin adapted to be latched by a latch on such door. Attached to the striker pin (not shown in FIG. 2) of the door jamb portion 25 and protruding from joint gap 34 is bar member 36 of the door-locking system 22; and to it is secured the lock member 37. The unitary (one-piece construction) substantially-flat bar member 36 embodies the bar means of this invention for rigid extension between striker pin 35 and lock member 37.

Lock member 37 includes a keyed lock 40, ratchet mechanism 41, and rigid retainer member 42, embodying herein a rigid retainer constructed and arranged for force transmission between such lock member and such door when such lock member is attached on such bar means and such lock member is in a locked condition. Rigid retainer member 42 has a protective pad 43 on its inward face 44, which protective pad 43 embodies herein a protective pad means for protecting such door from being scratched by such rigid retainer when placed between such rigid retainer and such door. The ratchet mechanism 41 of lock member 37 engages the tooth means for assisting attachment in ratchet fashion of such bar member to such lock at a user-selected location, the tooth means being embodied herein by the toothed edge 45 of bar member 36; and the lock member 37 may only be removed from the bar member 36 by unlocking the keyed lock 40, which in turn releases the ratchet of the ratchet mechanism 41.

In use, with the door 24 closed, the lock member 37 is moved adjacent the outside end of bar member 36 into a lockable location in such manner as to provide a restriction to an opening of tractor-cab door 24. Thus, the lock member 37 is adjustably secured to the bar member 36 which is strongly affixed to the door jamb portion 25 and protrudes from joint gap 34. As the lock member 37 is installed onto bar member 36, it is pushed into contact against the door 24 and door jamb portion 25 by the inward-only ratcheting motion. As the lock member 37 is pushed inward past each ratchet tooth of toothed edge 45 it may not be pulled outward until the keyed lock 40 is unlocked. The rigid retainer member 42 of the lock member 37 overlaps a portion of the outside of both the door 24 and the door jamb portion 25 so that the rigid retainer member 42 restrains and prevents the opening-outward side 23 of the door 24 from opening outward, thus securing the door. The portion of the rigid retainer member 42 which projects over the door jamb portion 25 prevents a force from extreme opening of door 24 from bending the bar member 36 and disabling the door-locking system 22. The soft cushioning of the protective pad 43 prevents the door 24 or door jamb portion 25 of the tractor cab 21 from being scratched or otherwise marred. With the door-locking system 22 installed on the tractor cab 21, the door may be opened only after unlocking the keyed lock 40 and sliding the lock member 37 off of the bar member 36. When the door-locking system 22 is not in use, the projecting bar member 36 may be either removed from the door jamb portion 25 or left in place for future use.

FIG. 3 is a perspective exploded view of the door-locking system 22 and its components and of the location on the tractor cab 21 where the door-locking system 22 is used. Located on the edge of the door jamb portion 25, facing toward the opening-outward side 23 (the side opposite the hinged side) of the tractor-cab door (not shown), is the striker pin 35. The striker pin 35 is the stationary portion of the truck's conventional door latch system, and is positioned to mate with the door latch mechanism (shown in FIG. 5) located on the door edge. The striker pin 35 is round, with an enlarged flanged head 46, and is the member to which the door-locking system 22 is attached. The bar member 36 of the door-locking system 22 is preferably a flat steel plate, approximately 1/16 thick and approximately 1 1/8" wide, generally rectangular in shape (shaped as shown), with a toothed extension 47 extending from one end, which is the outer end 51. The toothed extension 47 has a toothed edge 45 consisting of a plurality of inward facing teeth 48 for engagement by the lock member 37 in a well-known manner. As an example of the construction of lock member 37, reference is made to the Display Case Key Lock commercially available from Safety 1st Inc. of Chestnut Hill, Mass.

Centrally located on the bar member 36, near its inner end 52, is a round hole 53 which is sized in diameter slightly larger than the diameter of the flanged head 46 of the striker pin 35, so that it may be placed over striker pin 35. This arrangement embodies herein a holding means adjacent a first end of such bar means for securely holding such first end of such bar means in place abutting such striker pin. Affixed to the back side (the door jamb portion 25 side) of the bar member 36, near the extending toothed extension 47, as shown, is a small Velcro™ loop pad 54, embodying herein a first hook-and-loop attachment means on such bar member for aligning such bar member approximately horizontally, in such manner that the end of such bar member to be attached to the lock is exterior to the tractor cab, such first hook-and-loop attachment means being constructed and arranged for attachment to a second hook-and-loop attachment means on such door-jamb portion. When installing the door-locking system 22, the hole 53 of the bar member 36 is positioned over the flanged head 46 of the striker pin 35, with the outer end 51 of bar member 36 extending outward horizontally from the striker pin 35. The bar member 36 is held in place, against the door jamb portion 25, by engaging the Velcro™ loop pad 54 of the bar member 36 to a Velcro™ hook pad 55 which is permanently affixed to the door jamb portion 25, with adhesive, at the corresponding location, as shown, this arrangement embodying herein the alignment means of this invention for aligning such bar means approximately horizontally, in such manner that the second end of such bar means is exterior to the tractor cab. This use of mating Velcro™ loop pad 54 and hook pad 55 allow the bar member 36 to be installed or removed at will, yet provide an affixed location for proper alignment and rattle free retention. Completing the door-locking system 22 is the lock member 37 which is comprised of a keyed lock 40, ratchet mechanism 41, rigid retainer member 42, and a protective pad 43 on its inward face 44. The lock member 37 incorporates a through slot 56, through the protective pad 43, rigid retainer member 42 and the ratchet mechanism 41, for installing the lock member 37 on the toothed extension 47 of the bar member 36, such slot 56 embodying herein slot means for receiving such second (outside) end of such bar member. The ratchet mechanism 41 allows the lock member 37 to freely slide inward on the toothed extension 47, yet ratcheting interaction with each tooth 48 of the toothed edge 45 prevents the lock member 37 from sliding, or being pulled, from the toothed extension 47 until the keyed lock 40 is unlocked. The keyed lock 40 incorporates a standard barrel with tumblers, for actuation only with the appropriately mated key 57, and when actuated, disables the ratchet mechanism 41. Lock member 37 embodies the lock of this invention, when a such door is closed, being selectively attachable outward of the opening (the tractor door opening in the described embodiment) to such bar means adjacent the second end of such bar means, and such lock being selectively lockable outward of a such opening to such bar means. The protective pad 43, affixed with adhesive to the rigid retainer member 42, is a soft, non-abrading material, e.g., a Velcro™ loop pad. The bar member 36 and the lock plate 37 are preferably manufactured from a high-tensile-strength or hardened steel, either non-corrosive or plated for protection and appearance.

In FIG. 4 is shown a perspective view of the bar member 36 of the door-locking system 22, installed on the door jamb portion 25 of the tractor cab 21, as described in FIG. 3. The bar member 36 is shown extending outwardly horizontally from the striker pin 35 on which it is located. The Velcro™ loop pad 54 of the bar member 36 is engaged with the Velcro™ hook pad 55 of the door jamb portion 25, holding the bar member 36 in proper horizontal position. The toothed extension 47, embodying herein the lock attachment means of this invention adjacent a second end of such bar means for aiding attachment of such lock on such bar means, extends outward from the door jamb portion 25, ready for the closing of the door and for installation of the lock member 37 when the door is to be secured. The door-locking system 22 is operable with the toothed edge 45 of the bar member 36 facing either upward or downward, allowing for the option of the door-locking system 22 for both the left side door (as shown), and the right side door being identical.

FIG. 5 shows a cross-section view of the door 24 and the door jamb portion 25 at the location of the door-locking system 22 through section 5—5 of FIG. 2. In this illustration, the door 24 is shown closed and latched to the door jamb portion 25, and for security, the door is restrained from being opened by the door-locking system 22. Bar member 36 is mounted to the striker pin 35 and engaged with the Velcro™ hook-and-loop attachment at 55, securing the bar member 36 to the door jamb portion 25. The bar member 36 extends outward through the joint gap 34, between the door 24 and the door jamb portion 25, and has the lock member 37 (not shown in cross-section) installed against the door 24 and the door jamb portion 25. Also shown is the original equipment door latch 60, which remains undisturbed and functional as it is engaged with the striker pin 35. The protective pad 43 adhered to the inward face 44 of the rigid retainer member 42 prevents the painted surfaces of the door 24 and door jamb portion 25 from being scratched by the rigid retainer member 42 of the lock member 37.

The door-locking system 22 is illustrated attached to the door jamb portion 25 in the elevation view of FIG. 6. Since the hole 53 of the bar member 36 is slightly larger than the flanged head 46 (shown by dotted line) of the striker pin 35, when installing the bar member 36 to the door jamb portion 25, it is advantageous to pull the bar member 36 outward in contact with the striker pin 35 when positioning and attaching to the location at 55. This properly positions bar member 36 and also reduces possible rattling of the bar member 36. Once installed, the lock member 37 is secured to the toothed extension 47 of the bar member 36 by the ratchet mechanism 41 engagement with the inward facing teeth 48. The lock member 37 may only be removed by disabling the ratchet mechanism 41 with the keyed lock 40.

FIG. 7 is an elevation view of a holding-end portion of a bar member illustrating an alternate preferred embodiment. A modified form of the bar member 36 incorporates a slot system 61 in lieu of the hole 53 of the preferred embodiment. A vertical entry slot 62 provides an opening from the bottom edge of the bar member 36 and interconnects with a horizontal slot 63 which extends from the entry slot 61 towards the inner end 52 of the bar member 36. This slot system 61 allows the bar member 36 to be installed onto the striker pin 35 without requiring an enlarged hole for fitting over the flanged head 46 (shown by dotted line) of the striker pin 35. This feature is particularly advantageous if the flanged head 46 is significantly larger than the diameter of the striker pin 35 and would require a relatively large hole 53 in the bar member 36. This arrangement embodies a holding means of this invention which comprises a slot in such bar member constructed and arranged in such manner that a such striker pin, at smallest-diameter portion of such striker pin, may pass into such slot, and a receiving means in such bar member for holding such smallest-diameter portion of a such striker pin after such striker pin passes into such slot.

FIG. 8 is a perspective view of a second preferred embodiment of the lock attachment end of the door-locking system. One preferred embodiment of the lock member 37 incorporates the keyed lock 40, ratchet mechanism 41 and rigid retainer member 42 integrated into a one piece unit; but the preferred embodiment of FIG. 8 provides a ratchet/lock mechanism 64 separate from the rigid retainer member 42. A ratchet/lock mechanism 64 of this style is commonly found in hardware stores (an example part source having been herein earlier given). In this embodiment of the door-locking system 22, the rigid retainer member 42 and the ratchet/lock mechanism 64 are installed separately on the bar member 36. Also shown is the protective pad 43 prior to bonding to the rigid retainer member 42.

FIG. 9 is a perspective view illustrating an alternate preferred embodiment of the lock attachment end of the bar member and of the lock member. In lieu of the teeth 48 on the toothed edge 45 of the bar member 36, this embodiment instead incorporates a series of holes 65 positioned in a straight line longitudinally and extending to the outer end 51 of the bar member 36. A sliding pin lock 66 is then attached to the selected hole 65 which provides for the best positioning of a separate rigid retainer member 42 (not shown) to the door 24 and door jamb portion 25. A sliding pin lock 66 of the type required incorporates a lock pin 67 which extends and retracts as a function of the keyed lock 40 operation. When the lock pin 67 is retracted, a slot 68 in the sliding pin lock 66 allows positioning of the sliding pin lock 66 to the appropriate hole 65 of the bar member 36. When locked, the lock pin 67 extends through the selected hole 65 and into a support socket 69 in the opposing wall of the slot 68. This arrangement embodies the lock attachment means of the present invention comprising a horizontal series of holes in such bar member, each such hole being constructed and arranged to receive a lock pin at a user-selected location.

Door 24 and door jamb portion 25 construction differing from that previously described, may necessitate the modification shown in perspective in FIG. 10. If the door 24 overlaps the door jamb portion 25, not allowing the bar member 36 to extend through the joint gap 34, a modification to the door 24 is required. A notch 70 is cut in the door 24 to expose the joint gap 34 and provide a clearance opening for the bar member 36. Information describing the size and shape of the notch 70 could be provided to the individual performing the modification by the door-locking system 22 supplier in the form of a template or pattern. Additionally, a trim piece 71, of rubber, plastic, or chromed molding would be furnished to cover the raw edge of the cut notch 70. This arrangement embodies the tractor door of this invention comprising hole means for permitting the second end of the bar means to pass through such hole means when such tractor door is being closed.

From the above description, it is seen that the security door-lock system of this invention, for locking a tractor cab having a tractor-cab door and a tractor-cab door-jamb portion incorporating a striker pin adapted to be latched by a latch on such door, comprises the steps of: with such tractor cab door open, capturing such striker pin with a first end of a rigid bar in such manner as to prevent outward movement of such first end of such rigid bar; aligning such bar approximately horizontally in such manner that a second end of such bar is exterior to such tractor cab; closing such tractor-cab door in such manner that such second end of such bar remains extended from such tractor cab; providing a lock constructed and arranged to lock onto such bar adjacent such second end at a selected location; moving such lock adjacent such second end of such bar into a lockable location in such manner as to provide a restriction to an opening of such tractor-cab door; and locking such lock onto such bar.

Although applicant has described applicant's preferred embodiments of this invention, it will be understood that the broadest scope of this invention includes such modifications as diverse shapes and sizes and materials. Such scope is limited only by the below claims as read in connection with the above specification.

Further, many other advantages of applicant's invention will be apparent to those skilled in the art from the above descriptions and the below claims.

What is claimed is:

1. A security door-locking system for locking an opening incorporating a hinged door, with a hinged side and an opening-outward side, and, adjacent said opening-outward side of said door, a door-jamb portion incorporating a striker pin adapted to be latched by a latch on said door, said system comprising:

a. a lock; and b. bar means for rigid extension between said striker pin and said lock, said bar means being substantially flat and having first and second ends and comprising i. holding means adjacent said first end of said bar means for securely holding said first end of said bar means in place abutting said striker pin, and ii. lock attachment means adjacent said second end of said bar means for aiding attachment of said lock on said bar means;

c. said lock, when a said door is closed, being selectively attachable, outward of a said opening, to said bar means adjacent said second end of said bar means; and d. said lock being selectively lockable, outward of a said opening, to said bar means;

e. wherein said system is constructed and arranged in such manner that said door may be held securely shut when said lock is attached on said bar means and said lock is in a locked condition.

2. A security door-locking system according to claim 1 further comprising:

a. a rigid retainer constructed and arranged for force transmission between said lock and said door when said lock is attached on said bar means and said lock is in a locked condition.

3. A security door-locking system according to claim 2 further comprising:

a. a protective pad means for protecting said door from being scratched by said rigid retainer when placed between said rigid retainer and said door.

4. A security door-locking system according to claim 2 wherein:

a. said rigid retainer is constructed and arranged in such manner that, when said lock is attached on said bar means and said lock is in a locked condition, said rigid retainer abuts both a portion of said opening-outward side of said door, exterior to said opening, and an adjoining portion of said door-jamb portion, exterior to said opening.

5. A security door-locking system according to claim 4 further comprising:

a. a protective pad means for protecting said door and said adjoining portion of said door-jamb portion from being scratched by said rigid retainer when placed between said rigid retainer and said door and between said retainer and said adjoining portion of said door-jamb portion.

6. A security door-locking system according to claim 2 wherein:

a. said lock and said rigid retainer are formed as a unitary member.

7. A security door-locking system according to claim 1 wherein:

a. said bar means comprises a unitary substantially-flat bar member.

8. A security door-locking system according to claim 7 wherein:

a. said lock comprises slot means for receiving said second end of said bar member.

9. A security door-locking system according to claim 7 further comprising:

a. first hook-and-loop attachment means on said bar member for aligning said bar member approximately horizontally, in such manner that said second end of said bar member is exterior to said opening, said first hook-and-loop attachment means being constructed and arranged for attachment to a second hook-and-loop attachment means on said door-jamb portion.

10. A security door-locking system according to claim 8 wherein:

a. said holding means comprises a hole through said bar member constructed and arranged in such manner that a said striker pin may pass into said hole.

11. A security door-locking system according to claim 8 wherein:

a. said holding means comprises i. a slot in said bar member constructed and arranged in such manner that a said striker pin, at a smallest-diameter portion of said striker pin, may pass into said slot, and ii. a receiving means in said bar member for holding said smallest-diameter portion of a said striker pin after said striker pin passes into said slot.

12. A security door-locking system according to claim 8 wherein:

a. said lock attachment means comprises a horizontal series of holes in said bar member, each said hole being constructed and arranged to receive a lock pin at a user-selected location.

13. A security door-locking system according to claim 8 wherein:

a. said lock attachment means comprises tooth means for assisting attachment in ratchet fashion of said bar member to said lock at a user-selected location.

14. A security door-locking system for locking a tractor cab having a tractor-cab door and a tractor-cab door-jamb portion incorporating a striker pin adapted to be latched by a latch on said door, said system comprising:

a. a lock; and b. bar means for rigid extension between said striker pin and said lock, said bar means being substantially flat and having first and second ends and comprising i. holding means adjacent said first end of said bar means for securely holding said first end of said bar means in place abutting said striker pin, and ii. lock attachment means adjacent said second end of said bar means for aiding attachment of said lock on said bar means;

c. said lock, when said tractor-cab door is closed, being selectively attachable exterior to said tractor-cab door to said bar means adjacent said second end of said bar means; and d. said lock being selectively lockable exterior to said tractor-cab door to said bar means;

e. wherein said system is constructed and arranged in such manner that said tractor-cab door may be held securely shut when said lock is attached on said bar means and said lock is in a locked condition.

15. A security door-locking system according to claim 14 further comprising:

a. a said tractor-cab door;

b. a said tractor-cab door-jamb portion incorporating a striker pin adapted to be latched by a latch on said door; and c. a rigid retainer, between said lock and said tractor-cab door, constructed and arranged for force transmission between said lock and said tractor-cab door when said lock is attached on said bar means and said lock is in a locked condition.

16. A security door-locking system according to claim 15 wherein:

a. said rigid retainer is constructed and arranged in such manner that, when said lock is attached on said bar means and said lock is in a locked condition, said rigid retainer abuts both a portion of said door and an adjoining exterior portion of said door-jamb portion.

17. A security door-locking system according to claim 16 further comprising:

a. a protective pad means for protecting said door and said adjoining portion of said door-jamb portion from being scratched by said rigid retainer when placed between said rigid retainer and said door and between said rigid retainer and said adjoining portion of said door-jamb portion.

18. A security door-locking system according to claim 15 further comprising:

a. alignment means for aligning said bar means approximately horizontally, in such manner that said second end of said bar means is exterior to said tractor cab.

19. A security door-locking system according to claim 18 wherein:

a. said tractor door comprises hole means for permitting said second end of said bar means to pass through said hole means when said tractor door is being closed.

20. A security door-locking system for locking a tractor cab having a tractor-cab door and a tractor-cab door-jamb portion incorporating a striker pin adapted to be latched by a latch on said door, said system comprising the steps of:

a. with said tractor cab door open, capturing said striker pin with a first end of a substantially-flat rigid bar in such manner as to prevent outward movement of said first end of said rigid bar;

b. aligning said bar approximately horizontally in such manner that a second end of said bar is exterior to said tractor cab;

c. closing said tractor-cab door in such manner that said second end of said bar remains extended from said tractor cab;

d. providing a lock constructed and arranged to lock onto said bar adjacent said second end at a selected location;

e. moving said lock adjacent said second end of said bar into a lockable location in such manner as to provide a restriction to an opening of said tractor-cab door; and f. locking said lock onto said bar.

* * * * *